United States Patent [19]

Horn

[11] 4,202,509

[45] May 13, 1980

[54] COIL-CARRYING VEHICLE AND METHOD OF USING SAME

[76] Inventor: Gerald H. Horn, 6831 N. Frostwood Pkwy., Peoria, Ill. 61614

[21] Appl. No.: 965,120

[22] Filed: Nov. 30, 1978

[51] Int. Cl.[2] ..... B65H 75/40; B65H 49/00

[52] U.S. Cl. ..... 242/86.5 R; 242/129; 242/137.1

[58] Field of Search ..... 242/86.5 R, 129, 137.1, 242/77, 77.2, 77.3, 77.4; 280/47.17, 47.19, 45.35; 248/129

[56] References Cited

U.S. PATENT DOCUMENTS

| | | | |
|---|---|---|---|
| 3,072,367 | 1/1963 | Sprague | 242/86.5 R |
| 3,134,555 | 5/1964 | Baker | 242/86.5 R |
| 3,602,455 | 8/1971 | Lewis | 242/129 |
| 3,722,825 | 3/1973 | Phillips | 242/129 |
| 3,831,877 | 8/1974 | Bennett | 242/86.5 R |

*Primary Examiner*—Edward J. McCarthy
*Attorney, Agent, or Firm*—Reising, Ethington, Barnard, Perry & Brooks

[57] ABSTRACT

A portable cart for carrying boxes of coiled insulated wire and a method of pulling the coiled wire from the portable cart are disclosed. The cart includes a frame assembly having a plurality of interconnected horizontal and vertical frame members which define compartments spaced in a line along the major axis of the vehicle. Adjacent compartments are in fluid communication with each other by passages formed through common horizontal frame members. A guide assembly is mounted on the uppermost horizontal frame member which has a passage formed therethrough substantially aligned with the other passages and the holes defined by the loops of the coiled wire when the boxes of the coiled wire are disposed in their respective compartments. A collar member of the guide assembly guides the unwound portions of the wires and allows the unwound portions to be pulled therethrough individually, or simultaneously with selected ones of the unwound wire without disturbing the remaining unselected unwound wires. The unwound portions extend through the passages and the holes between their corresponding wound portions of coiled wire and the guide assembly.

10 Claims, 2 Drawing Figures

COIL-CARRYING VEHICLE AND METHOD OF USING SAME

TECHNICAL FIELD

This invention relates to vehicles for carrying coils of thread-like material and in particular to vehicles having a plurality of compartments for carrying boxed wire wherein the wire can be pulled therefrom.

BACKGROUND ART

Previous vehicles for carrying coils of wires typically comprise four wheeled carts having a plurality of unboxed coils disposed on elongated bars. The elongated bars extend through the holes defined by the loops of wire. These vehicles commonly employ a guide member having a like plurality of apertures formed therethrough, each of the unwound strands of wire extending through its own aperture. These carts resemble wagons in that they have four wheels and have a single bar connected to the frame vehicle, the bar having a two-handed handle at its opposite end.

Such prior art carts are especially cumbersome to use in wiring ceiling locations. Time must be taken in removing the coiled wires from their boxes and inserting the bar through the holes of the coiled wires. The unwound portions of the wires also frequently become entangled with each other. It is also cumbersome to pull more than one unwound portion of wire at the same time.

A need therefore exists for a wire cart that is not only simple and inexpensive but is convenient and efficient to use.

DISCLOSURE OF THE INVENTION

An object of the present invention is to provide a vehicle for carrying coils of thread-like material comprising a frame means for supporting the coils in a spaced linear relationship and wherein the frame means includes a plurality of interconnected horizontal and vertical frame members which define a plurality of compartments in which the coils are carried passages which place immediately adjacent compartments in fluid communication with each other, the passages being formed through the horizontal frame members common to adjacent compartments along a major axis of the frame means.

Another object of this invention is to provide a vehicle for carrying coils of thread-like material wherein the passages between adjacent compartments of the vehicle are substantially aligned with the holes defined by the loops of the carried coils along the major axis of the vehicle, the coils of the material being disposed in their respective compartments interiorly the frame means of the vehicle.

A further object of the invention is to provide a vehicle for carrying coils of thread-like material wherein a guide means mounted at the top of a frame means of the vehicle guides unwound portions of the carried coils and wherein each of the unwound portions extends through passages in common horizontal frame members of the vehicle and the holes defined by the coils which are disposed between its corresponding wound coil of material and the guide means to allow the thread-like material to be pulled orderly and quickly.

Yet another object of the present invention is to provide a vehicle for carrying coils of thread-like material having a plastic collar member supported at the top of the vehicle, the collar member having an aperture formed therethrough to allow unwound portions of the thread-like material to be pulled therethrough alone or simultaneously with selected ones of the unwound portion without disturbing the remaining unselected unwound portions.

Another object of this invention is to provide a vehicle for carrying coils of boxed-wire wherein means are provided on the vehicle for moving the vehicle to a desired location and wherein the means for moving the vehicle also supports the vehicle when the vehicle is in a reclining position.

In carrying out the above objects and other objects of the invention a preferred embodiment of this invention includes a frame means for supporting coils in spaced relationship and a means secured to the frame means for moving the frame means to a desired location. The frame means has a major axis and a minor axis. The frame means includes plurality of interconnected horizontal and vertical frame members defining a plurality of compartments spaced in a line along the major axis and interconnected by passages which place immediately adjacent compartments in fluid communication with each other. The passages are formed through the horizontal frame members common to adjacent compartments along the major axis of the frame means.

Further in carrying out the above objects and other objects of this invention a preferred method of practicing the invention comprises the steps of, cutting openings in boxes of wire substantially aligned with the holes defined by loops of the wires, placing the boxes in compartments having passages extending between the compartments, the openings and holes being substantially aligned with the passages and an aperture formed through a guide means mounted at the top of the vehicle. The method further comprises the steps of threading the wires through the passages, the openings, the holes and the compartments of the cart disposed between their respective wound portions of wire and the guide means and threading the unwound portions of wire through an aperture formed through the guide means.

The objects, features, and advantages of the present invention are readily apparent from the following detailed description of the best mode taken in connection with the accompanying drawings.

BEST MODE FOR CARRYING OUT THE INVENTION

Figure 2:
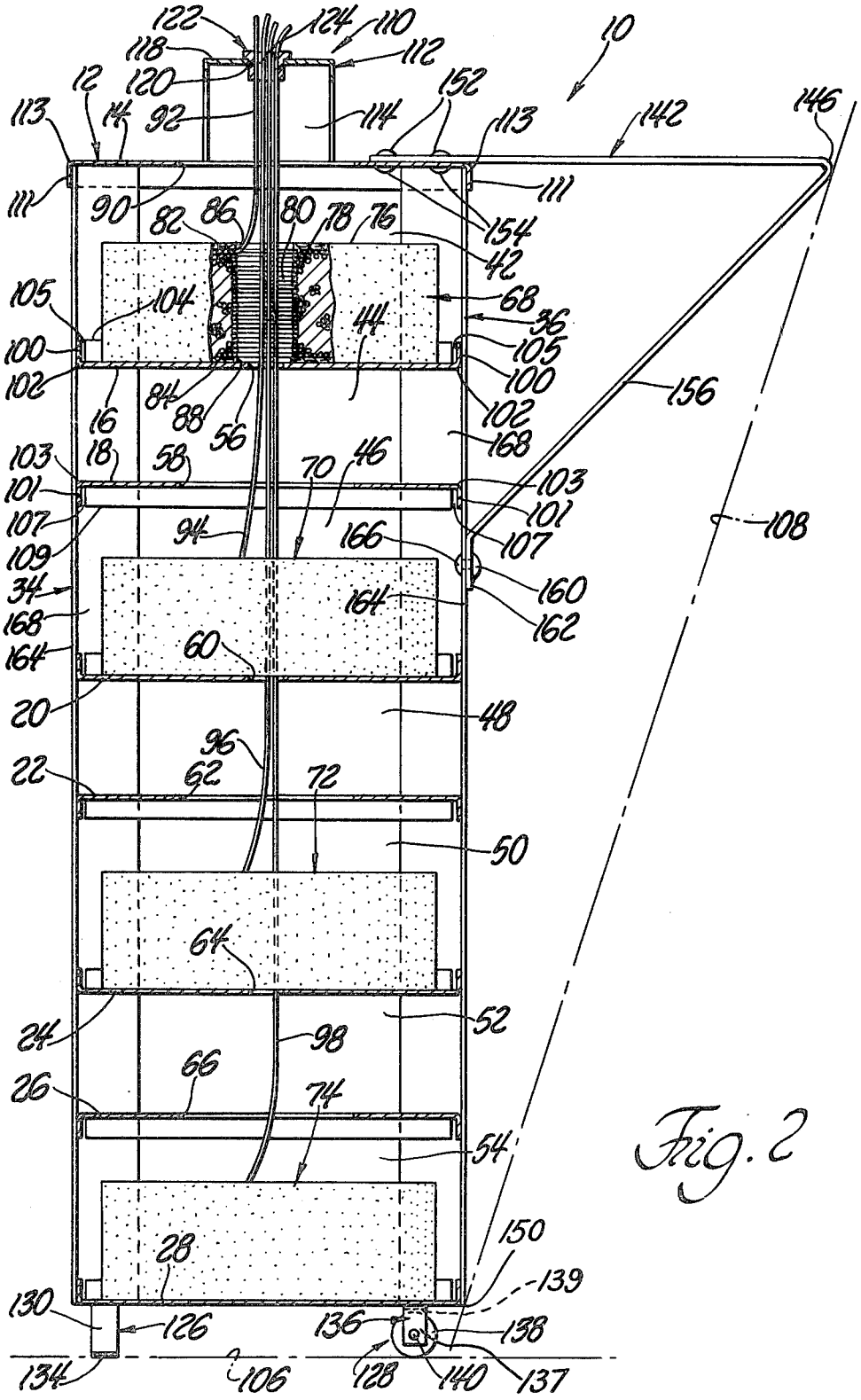
FIG. 2 is a side elevational view partially broken away and in cross section of the vehicle carrying boxes of wire in its upright position and in a reclining position.

Referring now to the drawings there is shown an illustrative embodiment of the invention in a vehicle generally indicated at 10 for carrying coils of thread-like material and, particularly, for carrying boxed coils of wire as shown in FIG. 2.

Figure 1:
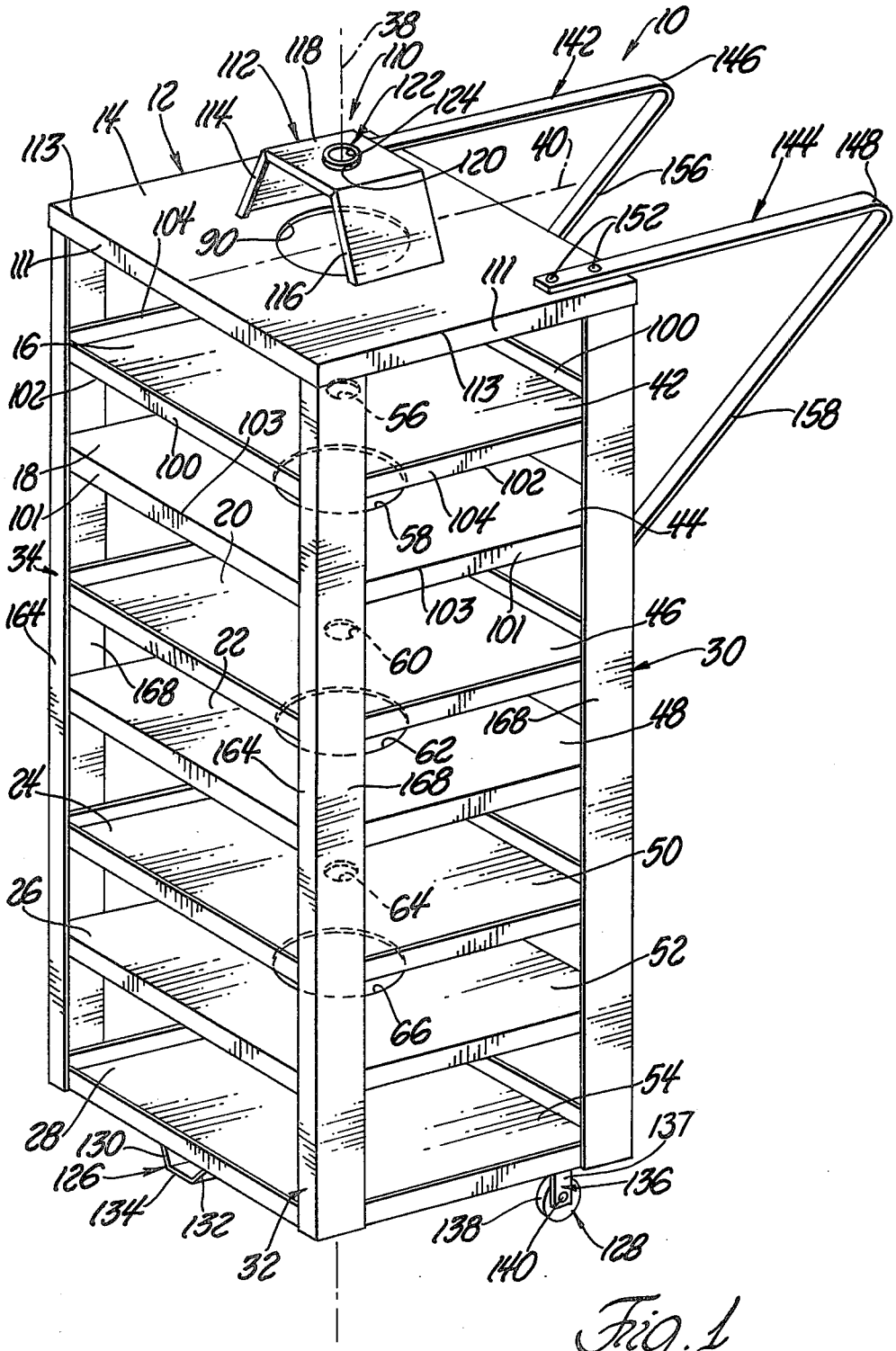
FIG. 1 is a perspective view of the coil-carrying vehicle of the invention.

The portable cart or vehicle of FIG. 1 shows an embodiment of the invention for carrying boxed coiled insulated wire and for pulling the wire from the boxes in a convenient and orderly fashion. The vehicle 10 comprises a steel metal frame means or assembly generally indicated at 12 including the plurality of interconnected horizontal steel frame members 14, 16, 18, 20, 22, 24, 26 and 28 and a plurality of interconnected vertical steel frame members 30, 32, 34 and 36. The frame assembly 12 has a major axis indicated at 38 extending along the height of the vehicle 10 and a minor axis indicated at 40, perpendicular the major axis 38, and extending along the length of the vehicle 10.

The horizontal frame members 16–28 and the vertical frame members 30–36 define a plurality of compartments 42, 44, 46, 48, 50, 52 and 54 which are spaced along the major axis 38. Adjacent compartments 42 and 44 are interconnected and are in fluid communication by a passage 56 and, in the same way, adjacent compartments 44 and 46, 46 and 48, 48 and 50, 50 and 52, 52 and 54 are interconnected by passages 58, 60, 62, 64 and 66, respectively.

Referring now to FIG. 2, there is shown boxes of coiled insulated wire generally indicated at 68, 70, 72 and 74 which are disposed in their respective compartments 42, 46, 50 and 54 interiorly the frame assembly 12. Each of the wire-filled boxes 68–74 are identical and only the wire-filled box 68 will be described.

The wire-filled box 68 comprises a rectangular cardboard box 76 in which coiled-wire strands of insulated wire form continuous loops 78 which define a hole 80 coaxial with the major axis 38. The insulation on the wire in each of the wire-filled boxes 68–74 typically has a color different from the colors of the insulations on the other wires. The wire-filled boxes 68–74 correspond substantially in size and shape to the size and shape of the compartments 42, 46, 50 and 54 such that, when the sides 82 and 84 of the box 76 are cut to provide openings 86 and 88, respectively, therethrough, the hole 80, the openings 86 and 88 and the passage 56 are all aligned as long as the side 84 of the box 76 lies flat on the top surface of the horizontal frame member 16 as will be described in greater detail hereinafter.

The uppermost horizontal member 14 also has a passage 90 extending therethrough to allow the unwound portions 92, 94, 96 and 98 of wire from the wire filled boxes 68–74 to extend therethrough and through the other passages, through the holes of coiled wire, openings, and compartments disposed between their corresponding wound coil of wire and the uppermost horizontal frame member 14. For example, the unwound portion of strand 98 extends from its wound wire-filled box 74 through its compartment 54, through the passage 66, through the compartment 52, through the passage 64, through the hole defined by the wire in the wire-filled box 72, through the compartment 50, through the passage 62, through the compartment 48, through the passage 60, through the compartment 46, through the hole defined by the coiled wire in the wire-filled box 70, through the passage 58, through the compartment 44, through the passage 56, through the opening 88, through the hole 80, through the opening 86, through the compartment 42, and through the passage 90.

All of the passages, holes, and openings are aligned or, in other words, a straight line can extend through all them as long as the wire-filled boxes 68–74 lay flat on the corresponding horizontal frame members 16, 20, 24 and 28 as shown in FIG. 2. In this way, the wire or wire strands from the wire-filled boxes 68–74 can be threaded through: the passages 56–66 and 90; the openings, including the openings 86 and 88; and, the holes, including hole 80, between their respective wound portions and the passage 90.

The horizontal frame members 16, 20, 24 and 28 are fixedly connected to the vertical frame members 30–36 such as by welding their integrally formed flanges thereto. Only the flanges 100 and 104 of the horizontal frame member 16 will be described since the flanges of the members 20, 24 and 28 are substantially identical. The flanges 100 and 104 project upwardly as shown in FIG. 1 from their respective edges 102 to retain the wire-filled box 68 in its respective compartment 42 when the vehicle 10 is in its upright position as shown in FIGS. 1 and 2, the vehicle resting on a surface 106 and when the vehicle 10 is in its reclining position as shown in FIG. 2, the vehicle resting on a surface 108.

Each of the generally rectangular flanges 100 is separated by a space 105 from its immediately adjacent flange 104 as shown in FIG. 2

The integrally formed flanges of the horizontal frame members 14, 18, 22 and 26 are also fixedly connected to the vertical frame members 30–36 such as by welding. Again, only the flanges 101 and 109 of the horizontal frame member will be described since the flanges of the members 22 and 26 are substantially identical. The flanges 101 and 109 extend downwardly as shown in FIG. 1 from their respective edges 103 to retain the wire-filled box 70 in its respective compartment 46, as previously described and especially if the vehicle 10 were to fall over into one of its sides such that the major axis 38 extended in a horizontal direction.

Also similarly, each of the severally rectangular flanges 101 is separated by a space 107 from its immediately adjacent flange 109 as shown in FIG. 2.

The uppermost horizontal member 14 has integrally formed flanges 111 extending downwardly from edges 113 and over the vertical frame members 30–36 and are fixed connected thereto also by welding. The member 14 holds the members 30–36 together and the wire-filled box 68 in its compartment 42.

The horizontal frame members 14, 18, 22 and 26 have round passages 90, 58, 62 and 66 respectively, formed therethrough which are equal in diameter and which are greater in diameter than the round passages 56, 60 and 64 which are also equal in diameter and which are formed through the horizontal frame members 16, 20 and 24. The larger diameter allows the unwound portions 92–98 of wire to easily extend therethrough and not bind on the edges defining the passages 90, 58, 62 and 66. If the wires of the unwound portions 92–98 are sufficiently rigid the unwound portions 92–98 will have to extend upwardly from its corresponding wire-filled box 68–74 certain distance before the unwound portions 92–98 extends in substantially straight line coaxial with the major axis 38. Because of this, the passages 90, 58, 62 and 66 are larger in diameter than the passages 56, 60 and 64, the edges of which merely guide the unwound strands 92–98 therethrough and do not have to be so wide in diameter to accommodate those still bent portions of the unwound portions 92–98.

If the horizontal frame members 16, 20 and 24 were also flanged in a downward direction and the horizontal frame members 18, 22 and 26 were also flanged in an upward direction the compartments 44, 48 and 52 could also serve to carry boxes of coiled wire therein to a desired location or be positioned in a substantially horizontal position as shown in FIG. 2. However, in the preferred embodiment, as shown in FIGS. 1 and 2, the compartments 44, 48 and 52 serve as buffer areas to allow the unwound portions 94–98 to unbend until they extend in a straight line along the major axis 38. Also, the compartments 44, 48 and 52 could carry wire-filled boxes if the vehicle 10 was only used in its vertical upright position.

The vehicle 10 also includes a guide means or guide assembly generally indicated at 110 which is fixedly secured at the top surface of the uppermost horizontal frame member 14 such as by welding. The guide assembly 110 includes a steel metal bracket generally indicated at 112 and which has a pair of support legs 114 and 116 which are integrally formed with a base member 118 which is centered over the aperture 90. The base member 118 has a hole 120 extending therethrough in which a cylindrical plastic collar member generally indicated at 122 is disposed. The collar member 122 has an aperture 124 extending therethrough which is coaxial with the major axis 38 and with the passages 90 and 56–66. The unwound portions 92–98 of the wires extend through the passage 90 and the aperture 124 when threaded therethrough, the collar member 122 serving to guide the unwound portions 92–98 as they are pulled therethrough individually or simultaneously with selected ones of the unwound portions without disturbing the remaining unselected unwound portions.

As shown in FIG. 2, when the vehicle 10 rests in its upright position on the surface 106 the unwound portions 92–98 are typically pulled through the aperture 124 to wire ceiling electrical boxes. When the cart is in its substantially horizontal position as also shown in FIG. 2, resting on the surface 108, the unwound portions 92–98 of the wires are typically pulled through the aperture 124 to wire lower electrical boxes.

The vehicle 10 is supported in its upright position by a foot means or vertical steel foot bracket generally indicated at 126 and a pair of wheel means or wheel assemblies only one of which is generally shown at 128. The foot bracket 126 includes a pair of support legs 130 and 132 which are fixedly mounted at the bottom surface of the bottommost horizontal frame member 28, such as by welding, and also includes a base member 134 integrally formed therewith the leg members 130 and 132. The base member 134 presents a flat resting surface for engaging the surface 106 to support the vehicle 10 thereon. Also, the foot bracket 126 acts as a support when the vehicle 10 is in a transport position to carry material thereon for transfer from place to place.

Each of the wheel assemblies including the wheel assembly 128 includes an angular bracket generally indicated at 136 to which a caster wheel 138 is pivotally attached by a pin 140 extending through a hole in a portion 137 of the bracket 136. The bracket 136 is fixedly mounted on the lower surface of the bottommost horizontal frame member 28 at a portion 139 of the bracket 136 such as by welding.

The wheel assemblies not only provide support for the vehicle 10 in an upright position but also allow the vehicle 10 to rotatably move in a range of transport positions between the upright position and the substantially horizontal position. In the transport positions the vehicle 10 is tilted from the vertical upright position by a pair of handle means or bars generally indicated at 142 and 144 which are fixedly mounted on the frame assembly 12 and which allow the vehicle 10 to be moved to a desired position or place.

The vehicle 10 is placed in its reclining position by tilting the vehicle 10 in the direction of its minor axis 40 until bent elbow portions 146 and 148 of the bars 142 and 144, respectively, rest on the surface 108 together with a bottommost edge 150 of the lowermost horizontal frame member 28. Each of the bars 142 and 144 are fixedly mounted on the upper surface of the uppermost horizontal frame member 14 by pairs of rivets or pins 152 which extend therethrough their respective bars 142 and 144 and through the uppermost horizontal frame member 14 and are secured in position at the inner surface of the uppermost horizontal member 14 either by welding or by locking members 154.

In the same fashion, the lowermost portions 156 and 158 of the bars 142 and 144, respectively, are fixedly secured by rivets or pins 160 which extend through a flanged portions 162 of the lowermost portions 156 and 158 and through flanges of the vertical frame members 30 and 36. Likewise, the pins 160 are fixedly secured at the inner surface of the flanges of the members 30 and 36 by welding or by locking members 166.

Each of the vertical frame members 30–36 include a pair of integrally formed flanges 164 and 168 which, together with the flanges of the horizontal frame members 14–28, define retainer means for retaining the wire-filled boxes 68–74 in their respective compartments 42, 46, 50 and 54 and which maintain the alignment of the holes, the passages 58–66, and 90 and the openings when the vehicle 10 is in its vertical upright, transport, and substantially horizontal positions.

While a preferred embodiment of the vehicle has been shown and described herein in detail, those skilled in this art will recognize various alternative designs and embodiments for practicing the present invention as defined by the following claims.

What is claimed is:

1. A vehicle for carrying coils for thread-like material each of the coils having loops which define holes, said vehicle comprising:

frame means for supporting said coils in spaced relationship, and means secured to said frame means for moving said frame means to a desired location, said frame means having a major axis and a minor axis, said frame means including a plurality of interconnected horizontal and vertical frame members defining a plurality of compartments spaced in a line along said major axis and interconnected by passages which place immediately adjacent compartments in fluid communication with each other, said passages being formed through the horizontal frame members common to adjacent compartments along the major axis of said frame means and wherein said passages are substantially aligned with the holes defined by loops of the coils along said major axis, said coils of material being disposed in their respective compartments interiorly the frame means.

2. The vehicle as claimed in claim 1 wherein said vehicle includes guide means secured at the top of the frame means for guiding unwound portions of the carried coils of material, each of the unwound portions extending through the passages in said common horizontal frame members and the holes disposed between its corresponding wound coil of material and the guide means.

3. The vehicle as claimed in claim 2 wherein said guide means is secured to the uppermost horizontal frame member of said horizontal frame members, a passage through the uppermost horizontal frame member allowing all of the unwound portions to extend therethrough and wherein said guide means includes a plastic collar member supported on the uppermost horizontal frame member, said collar member being an aperture formed therethrough substantially aligned with said passages and holes for allowing said unwound portions to be pulled therethrough alone or simultaneously with selected ones of the unwound portions without disturbing the remaining unselected unwound portions.

4. The vehicle as claimed in claim 1 or claim 3 wherein said means for moving said frame means includes at least one handle means extending along said minor axis and mounted on one side of the frame means between the top and bottom of said frame means.

5. The vehicle as claimed in claim 4 wherein said means for moving said frame means includes a second handle means spaced from said first handle means and mounted on said frame means, said first and second handle means cooperating to support said frame means, said frame means being in a reclining position.

6. The vehicle as claimed in claim 5 wherein said means for moving said frame means includes at least one wheel means connected at the bottom of said frame means for allowing rolling movement of said vehicle to a desired position.

7. The vehicle as claimed in claim 6 wherein said vehicle includes a second wheel means connected at the bottom of said frame means and cooperating with said first wheel means to allow said rolling movement and further includes foot means disposed at the bottom of said frame means, said foot means and said first and second wheel means supporting said frame means, said frame means being in an upright position.

8. The vehicle as claimed in claim 7 wherein said foot means comprises a bracket member having a level bottom portion, said bracket member being fixedly mounted on the bottom surface of the bottommost horizontal frame member.

9. The vehicle as claimed in claim 1 inlcuding retainer means for retaining the coils in their respective compartments and maintaining substantial alignment of the holes and the passages, said frame means being moved to a desired location in a transport position.

10. The vehicle as claimed in claim 9 wherein said retainer means is defined by integrally formed flanges of said vertical and horizontal frame members, each of the coils being disposed in a box, all of the boxes substantially corresponding in size and shape with its respective compartment, each box having openings formed therethrough substantially aligned with the hole of its corresponding coil and the passages in said transport position.

* * * * *